US007464489B2

(12) United States Patent
Ho

(10) Patent No.: US 7,464,489 B2
(45) Date of Patent: Dec. 16, 2008

(54) FOOTWEAR CUSHIONING DEVICE

(75) Inventor: Danny Ho, Los Angeles, CA (US)

(73) Assignee: ACI International, Los Angeles, CA (US)

( * ) Notice: Subject to any disclaimer, the term of this patent is extended or adjusted under 35 U.S.C. 154(b) by 239 days.

(21) Appl. No.: 11/191,411

(22) Filed: Jul. 27, 2005

(65) Prior Publication Data

US 2007/0022631 A1 Feb. 1, 2007

(51) Int. Cl.
*A43B 13/18* (2006.01)
*A43B 13/20* (2006.01)

(52) U.S. Cl. ..... 36/28; 36/29; 36/35 B; 36/35 R

(58) Field of Classification Search ..... 36/28, 36/29, 35 R, 35 B
See application file for complete search history.

(56) References Cited

U.S. PATENT DOCUMENTS

| | | | | |
|---|---|---|---|---|
| 4,439,936 | A | 4/1984 | Clarke et al. | |
| 4,535,553 | A | 8/1985 | Derderian et al. | |
| 4,559,724 | A | 12/1985 | Norton | |
| 4,562,651 | A | 1/1986 | Frederick et al. | |
| 4,817,304 | A | 4/1989 | Parker et al. | |
| 4,936,029 | A | 6/1990 | Rudy | |
| 5,042,176 | A | 8/1991 | Rudy | |
| 5,233,767 | A | 8/1993 | Kramer | |
| 5,245,766 | A | 9/1993 | Warren | |
| 5,343,639 | A | 9/1994 | Kilgore et al. | |
| 5,381,608 | A | 1/1995 | Claveria | |
| 5,384,973 | A | 1/1995 | Lyden | |
| 5,595,004 | A | 1/1997 | Lyden et al. | |
| 5,628,129 | A | 5/1997 | Kilgore et al. | |
| 5,685,090 | A | 11/1997 | Tawney et al. | |
| 5,713,141 | A | 2/1998 | Mitchell et al. | |
| 5,832,636 | A | 11/1998 | Lyden et al. | |
| 5,979,078 | A | 11/1999 | McLaughlin | |
| 5,987,780 | A | 11/1999 | Lyden et al. | |
| D429,877 | S | 8/2000 | Lozano et al. | |
| 6,132,663 | A | 10/2000 | Johnson et al. | |
| 6,233,846 | B1 | 5/2001 | Sordi | |
| 6,305,100 | B1 | 10/2001 | Komarnycky et al. | |
| 6,457,261 | B1 * | 10/2002 | Crary | 36/27 |
| 6,487,796 | B1 | 12/2002 | Avar et al. | |
| 6,568,102 | B1 * | 5/2003 | Healy et al. | 36/28 |
| 6,647,646 | B2 | 11/2003 | Mitsui et al. | |
| 6,730,379 | B2 | 5/2004 | Bonk et al. | |
| 6,763,611 | B1 | 7/2004 | Fusco | |
| 6,796,056 | B2 | 9/2004 | Swigart | |
| 6,826,852 | B2 | 12/2004 | Fusco | |

(Continued)

*Primary Examiner*—Ted Kavanaugh
(74) *Attorney, Agent, or Firm*—Greenberg Traurig, LLP

(57) ABSTRACT

A cushioning device for a footwear sole has multiple vertically directed columns. One column is located on a medial side and another is located on a lateral side, and are adjacent and spaced apart from each other. The medial column has the relatively larger volumetric property relative to the volumetric property of the lateral column. In another sense at least one of the columns has different elastomeric and/or compression properties relative to other columns. The device is located between an upper support plate and a lower support plate, and the support plates have more rigid characteristics than the cushioning device. Each column includes an upper larger area and a lower smaller area, and downwardly directed walls taper inwardly towards a lower location. The lower portion is where the bases of the columns are spaced apart.

11 Claims, 7 Drawing Sheets

U.S. PATENT DOCUMENTS 6,851,204 B2 2/2005 Aveni et al.
6,857,205 B1 2/2005 Fusco et al.
6,880,267 B2 4/2005 Smaldone et al.
6,898,870 B1 5/2005 Rohde
6,915,596 B2 7/2005 Grove et al.
6,931,764 B2 8/2005 Swigart et al.
6,931,766 B2 8/2005 Greene
6,964,120 B2 * 11/2005 Cartier et al. ..... 36/29
6,968,636 B2 11/2005 Aveni et al.
6,968,637 B1 11/2005 Johnson
6,990,755 B2 1/2006 Hatfield et al.
7,000,335 B2 2/2006 Swigart et al.
2004/0181969 A1 * 9/2004 Smaldone et al. ..... 36/28
2006/0112592 A1 * 6/2006 Leedy et al. ..... 36/29
2006/0137220 A1 * 6/2006 Hardy et al. ..... 36/28
2007/0193065 A1 8/2007 Nishiwaki et al.

* cited by examiner

FIG. 5
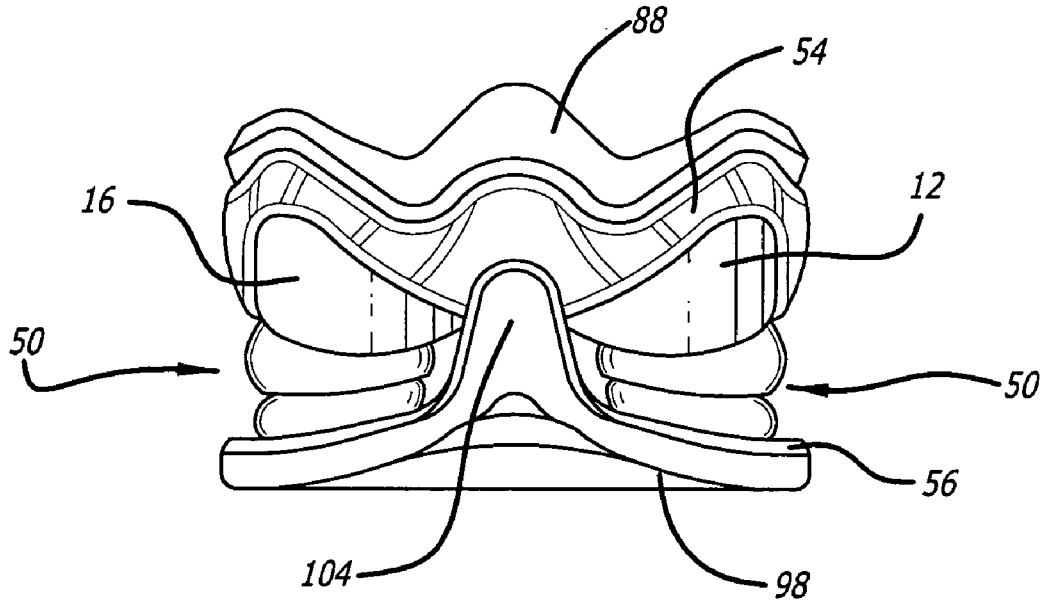
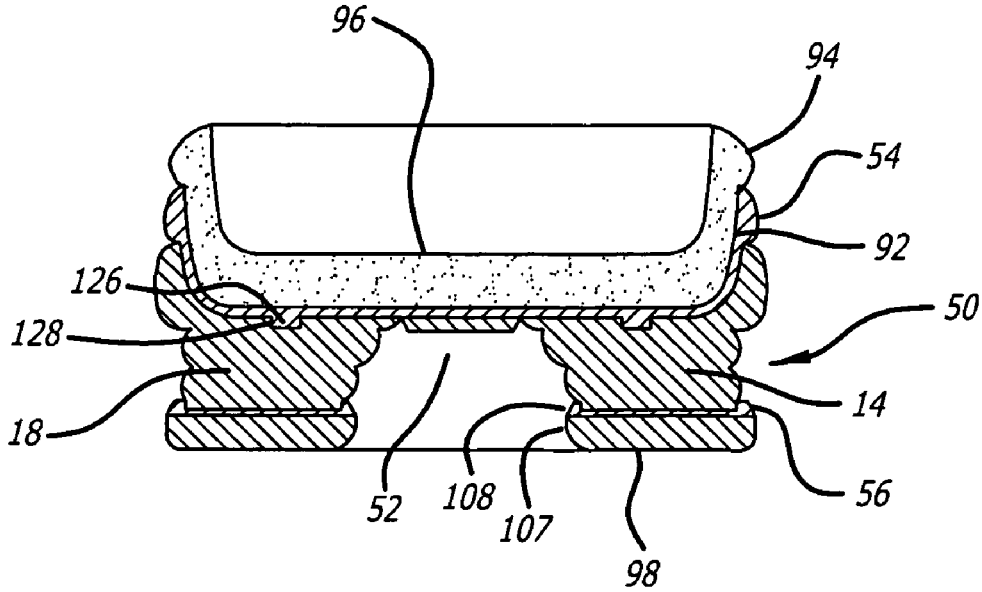
FIG. 6

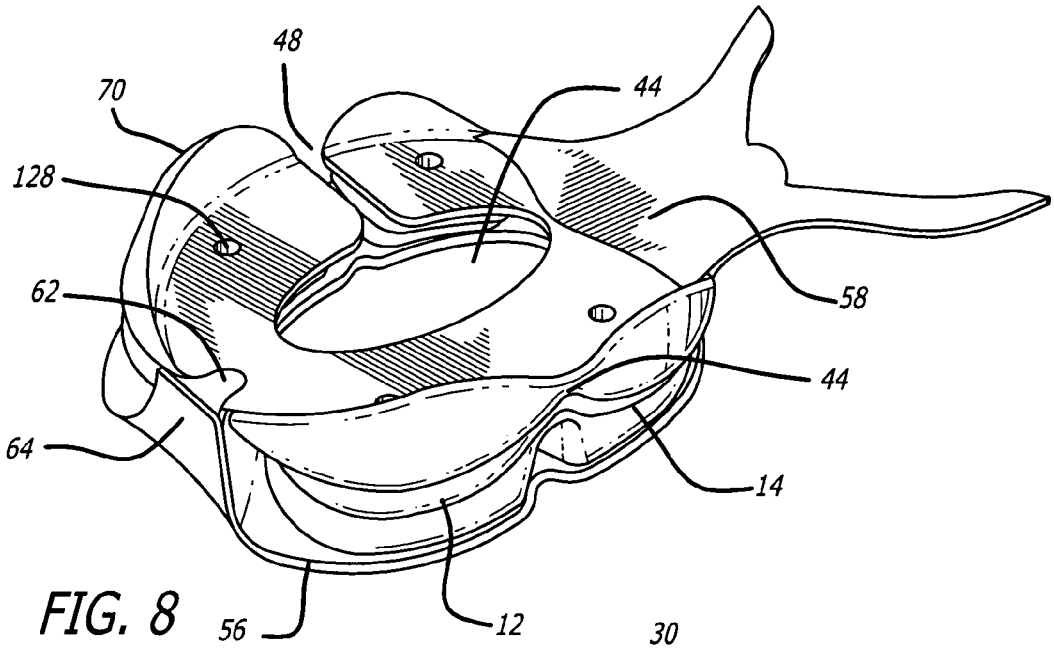
FIG. 8
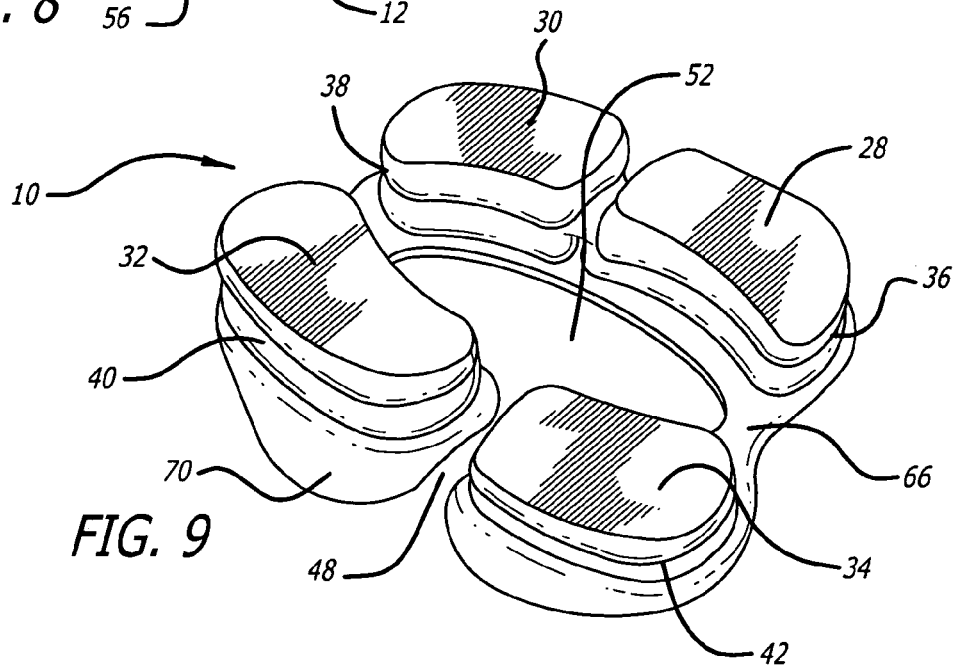
FIG. 9
FIG. 10A
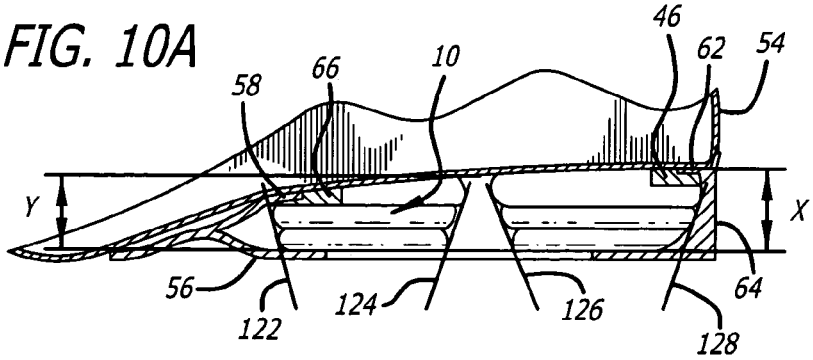

FIG. 10B
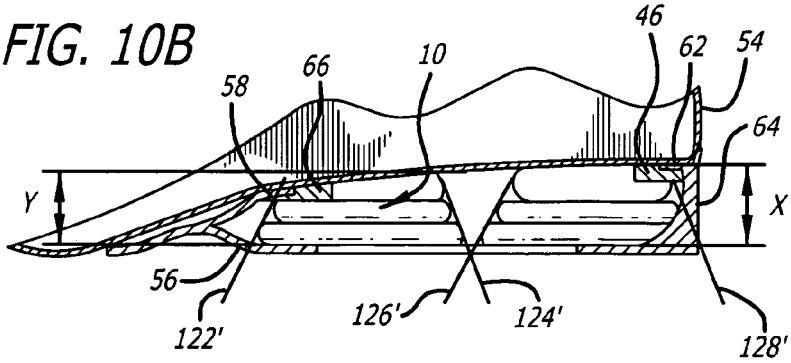
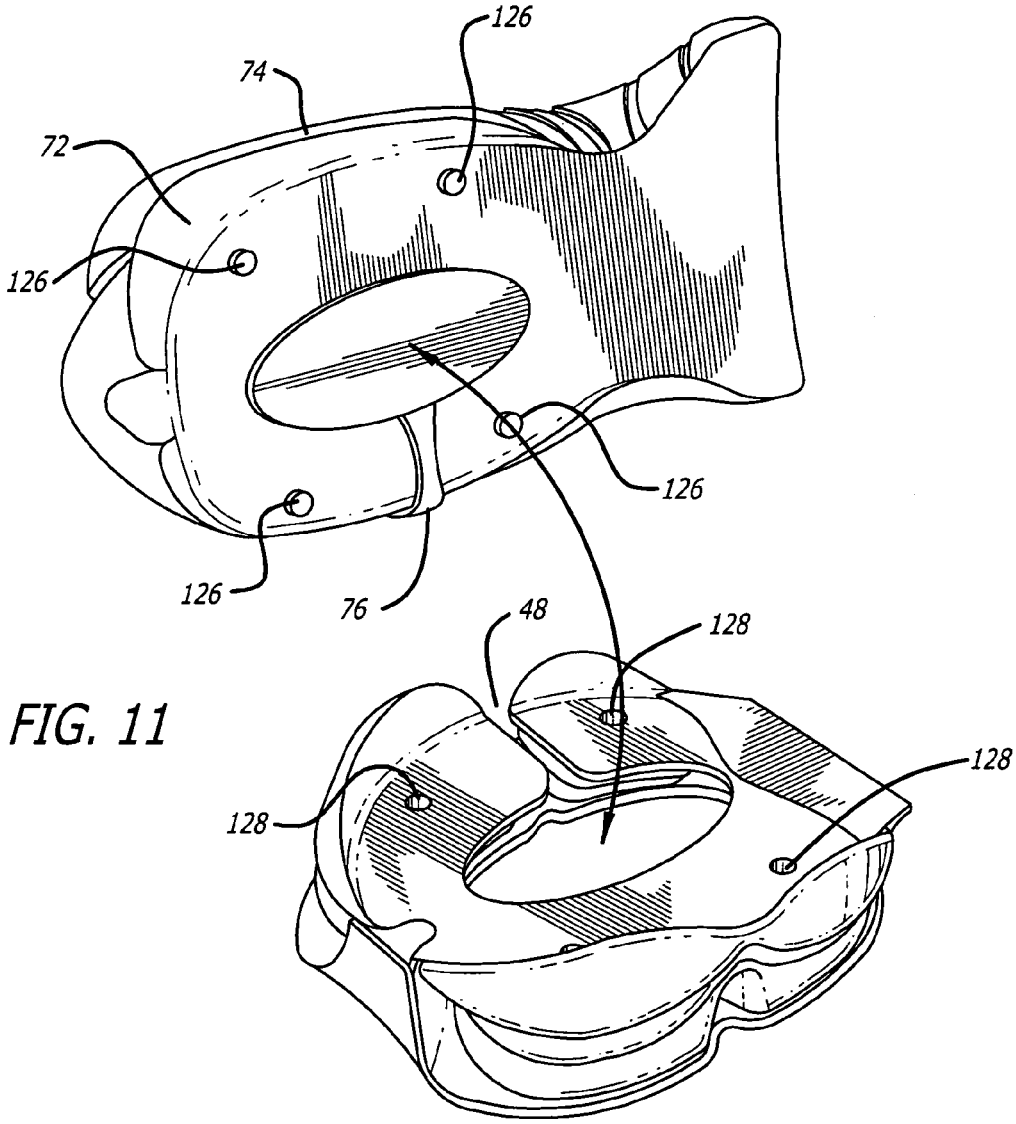
FIG. 11

FOOTWEAR CUSHIONING DEVICE

RELATED APPLICATIONS

This application is related to a United States utility patent application filed Jul. 27, 2005, entitled FOOTWEAR CUSHIONING METHOD. The contents of that application are incorporated herein by reference.

BACKGROUND

This disclosure relates to footwear in general and in particular to a cushioning device for footwear. In particular, it is concerned with such a device in the heel of footwear. Different devices are known to improve the comfort of footwear. Athletic footwear use different devices for improving the comfort during walking or running. This action usually starts with a heel strike followed with a rolling on to the midfoot and finally, the action of the forefoot. When the heel strikes, there can be forces involved on the ankle, knee and hip which flex to cushion and absorb the shock of the impact. The foot then rolls and turns inwardly in a process called pronation or outwardly in a process called supination. In other terms, the process of pronation or supination is the flattening out of the arch when the foot strikes the ground. Normally, the foot pronates or supinates to absorb shock when the heel hits the ground, and to assist in balance during mid-stance. The ankle tips or tilts towards the inside or outside of the foot.

Excessive pronation can be problematic because the shifting causes increased stress on the inside/medial aspect of the foot. It pulls on the stabilizing muscles in the lower leg (posterior tibialis) and often causes the knee to shift to the inside. The excessive stress on the body can overcompensate for this pronation and shift the ankle towards the outside causing the ankle to roll over.

Supination is the opposite motion of pronation. This occurs when the ankle tips or tilts outwards. This can cause difficulty in running and walking. A foot is in supination when the ankle is tipped to the outside.

Excessive supination predisposes the ankle to injury because the stabilizing muscles on the outside of the lower leg (peroneals) are in a stretched position. It does not take much force to cause the ankle to roll over, potentially causing ligament damage. Every person pronates and supinates. It is the body's way to absorb shock and allow the foot to work as a lever. Excessive motion in either direction can be problematic if not controlled.

In other situations, a foot may be prone to super-pronation. This is when a foot is not flat, but tilts slightly inwards or outwards. This can cause difficulty in running and walking.

It is desirable to absorb as much foot strike shock energy as possible consistent with stability and avoiding injury to the foot. It is also desirable to store shock energy and return it to the foot to facilitate energy transfer when the foot leaves the ground. It is also desirable to limit the tendency of the foot to over-pronate or over-supinate during the contact of the foot with the ground.

It is known to include spring devices in the soles of shoes. Spring devices in the heels store shock energy imparted by the foot strike during running and return a portion of that to the wearer's foot during foot lift. It is also known to provide longitudinal stiffening elements within a shoe to overcome or minimize the effect of over-pronation or over-supination during running.

None of the known devices provides for a good balance, cushion and shock absorption for the foot in a manner that minimizes the disadvantages and accounts for over-pronation or over-supination tendencies by reducing their effect.

This disclosure relates to a cushioning device which reduces the disadvantages of known systems and aids in the prevention of over-pronation or over-supination effects.

SUMMARY

The disclosure relates to a cushioning device formed of multiple essentially vertically directed columns for location in the sole, preferably the heel of footwear. The columns are formed so that at least some of them have different volumetric space and/or different elastomeric and/or compression properties relative to other columns.

In a preferred form, there are four spaced columns—two in a forward position and two in a rearward position—of the heel.

In one form of the disclosure there are only four columns about the periphery of the cushioning device. The rear columns have relatively greater compressibility characteristics than the forward columns. By that is meant that it is effectively more difficult to compress the rear columns either singly or collectively than the forward columns either singly or collectively.

In another manner of the disclosure the rear columns collectively have different, preferably more, volumetric space than the forward columns collectively In another form at least some of the columns have different elastomeric properties relative to other columns. This means that some columns have a relatively denser or lesser elastomeric property relative to the elastomeric property of another column, and in that sense is relatively slower to return to a non stressed or non deformed state or condition.

The rearward lateral column is relatively larger than the corresponding forward lateral column. The medial forward column is relatively larger than the rearward lateral column. The forward medial column is relatively larger than the rearward lateral column.

In another aspect of disclosure the cushioning device is of a nature that the rearward portion of the cushioning device as defined by the rear lateral and medial columns is higher in a vertical sense than the forward portion of the cushioning device as defined by the front lateral and medial columns.

The columns are formed so that the relative area essentially horizontally of the uppermost portion of the columns is larger than the relative square area of the lower horizontal portions of the columns. The columns, when considered from a side view, essentially taper from the upper horizontal area towards the lower horizontal area. In this one form, the walls of the columns essentially are broader at the top of the cushioning device and narrower at the bottom of the cushioning device.

In another form, the columns are formed so that the relative area essentially horizontally of the uppermost portion of the columns is smaller than the relative square area of the lower horizontal portions of the columns. The columns, when considered from a side view, essentially taper from the lower horizontal area towards the upper horizontal area. The walls of the columns essentially are smaller at the top of the cushioning device and larger at the bottom of the cushioning device.

In some forms, the columns on the medial side are joined. In other forms, the columns on the lateral side are joined. In yet other forms, the columns on each of the medial and lateral side are joined. The two front columns are joined and the two rear columns are joined in other forms. In another preferred form, the lateral forward column is joined with the medial forward column, which is joined with the medial rearward column that is joined with the rearward lateral column.

In another preferred form, the columns are essentially functionally separate or essentially functionally independent from each other.

In other forms of the disclosure, one or more of the columns have upwardly directed skirts for embracing a portion of the footwear above the cushioning device. A skirt is an outer edge; a border or margin around the columns.

In yet other forms of the disclosure, the cushioning device is located between two relatively rigid support plates. One of these plates is a lower plate and the second is an upper plate.

The lower plate in some forms is selectively contains formations for receiving the lower horizontal bases of the respective columns. In some forms there is also a mouth at the leading end of the lower plate into which a forward end of the cushioning device is locatable, thereby to facilitate positioning of the cushioning device with the support element. In yet some other forms of the disclosure, one or more of the support members includes a formation for facilitating the securing of the cushioning device between the support members. This feature can be a hook, tongue, lip or protrusion.

In some forms the upper support plate is for location above the cushioning device and selectively includes apertures or pins in the base of the support element, the apertures or pins being generally aligned with the top horizontal portions of the columns. In some forms the apertures or pins are for engaging in a molding operation with the top of the columns of the cushioning device.

In a further preferred form of the disclosure, the embracing skirt of the cushioning device matingly engages with the periphery of the upper support device. The upper support device has a peripheral skirt for relative internal location in relationship to the peripheral skirt of the cushioning device. The skirt of the support is an outer edge; a border or margin around the support.

In one form of manufacturing, the cushioning device is formed by a first molding process, and the support plates are formed by another molding process. The molding process for the cushioning may be pressure molding and the support plates may be injection molding.

The cushion device is located between the support plates and is suitably anchored so as to form an integrated sandwich feature with the cushion device supported securely between the support plates. Thereafter, in some cases, the cushioning device and support plates are molded or otherwise secured or formed into place between an outer sole and selectively a mid-sole or inner sole thereby to form an integrated sole for the footwear.

In a different form the integrated plates and cushioning device is formed as an integrated unit when the mid and outer soles are formed in the molding process.

The lower or bottom support plate can have a peripheral area with a cutout formation centrally located such that the base of the upper support plate is visible through the cutout. The outer sole can similarly have a cutout formed to conform with the cutout of the lower support plate.

At least one of the support plates is formed with a peripheral skirt having indentations or a shape to conform with the perimeter areas of the cushioning device.

This disclosure also includes footwear incorporating the sole formed with the cushioning device.

A better understanding of the device alone with its advantages can be determined from the following detailed description in light of the accompanying drawings.

DRAWINGS

The above-mentioned features and objects of the present disclosure will become more apparent with reference to the following description taken in conjunction with the accompanying drawings wherein like reference numerals denote like elements and in which a left shoe is shown. A mirror image arrangement applies to a right shoe.

FIG. 5 is a rear view illustrating the outer sole, support plate, cushioning device, upper support plate and mid-sole.

FIG. 6 is a cross sectional view from the rear along lines 6-6 illustrating the outer sole, support plate, cushioning device, upper support plate and mid-sole

FIG. 8 is a perspective view illustrating the cushioning device and the lower support plate.

FIG. 9 is a perspective view illustrating the cushioning device.

FIG. 10A is a cross sectional side view illustrating the lower support plate, the cushioning device and the upper support plate.

FIG. 10B is a cross sectional side view illustrating the lower support plate, the cushioning device and the upper support plate, with the taper of the columns oppositely directed relative to FIG. 10A.

FIG. 11 is an exploded perspective view illustrating the lower support plate, the cushioning device, and the upper support plate.

DETAILED DESCRIPTION

Figure 1:
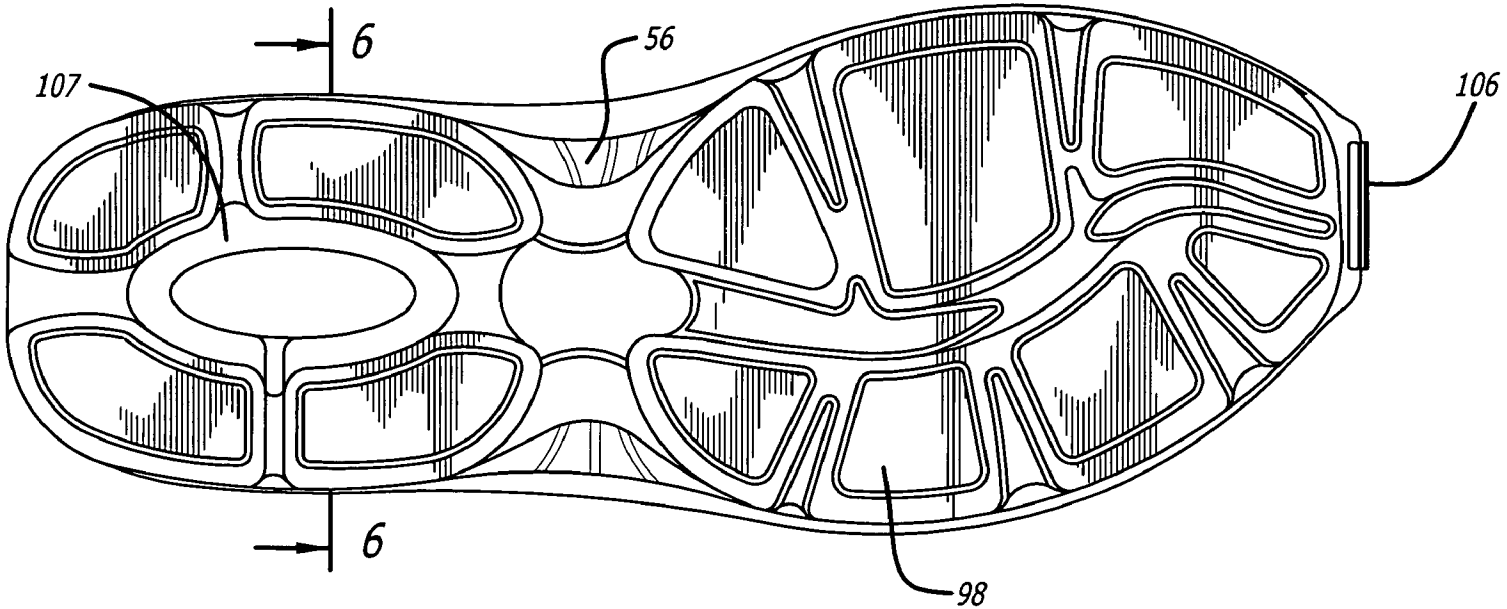
FIG. 1 is an underview of the outer sole illustrating different tread patterns. In the heel area four distinct zones are visible representative of the locations of the columns of the cushioning device.

The disclosure is now described with reference to the exemplary drawings of a left shoe.

A cushioning system is disclosed. This provides for more efficient distribution of weight and energy with four-column configuration to deliver relatively more cushioning and better impact absorption. Using four configured tapering PU cushioning columns shaped in the selected optimal-lateral and medial-strike zones of heel, the cushioning system achieves a good balance of greater energy return and increased impact stability for better running performance.

In a preferred form there is a one-piece TPU/EVA dual density cushioning system, which more efficiently distributes weight and energy with four columns configuration.

Differing column design provides optimal heel displacement cushioning and allows for more efficient transfer of energy from impact to propulsion phase. There are lateral dual flex independent suspension columns. These are designed to allow for greater range of flexibility and more efficient transfer of energy from impact to launch, and insure a well-balanced yet adaptable step.

There are relatively level cushion zones on each column designed to provide relatively more compression and energy return. There are three level cushion zones provide for better flex range on each column. The three level cushion zones provide for better cushioning during impact and energy return on each column. This provides better cushioning since the foot is laden with 2 to 3 times the wearer's body weight of force when the foot first comes in contact with the ground.

A heel strike stability bridge can be integrated into an arched column on the medial side for better relatively more solid medial support.

A dual shank stability system with lower stability plate can be integrated with the upper chassis shank system and is designed to absorb and direct distribution of shock pressure to outside areas of heel. The lower stability plate works together with the upper chassis system is designed to distribute the pressure evenly to provide enhanced performance and a stable platform. There is effectively good energy return from spring plate with dual density configuration cushioning system. There is effectively good energy return from a spring plate with multiple, preferably dual, density configuration cushioning system.

Anti pronation arch stability is built into the arch column on medial side giving greater rigidity, while lateral side columns allow for more flexibility with separated columns.

A heel strike stability bridge is built into an arched column on medial side giving greater stability and additional pronation control, while lateral side columns allow for optimal heel-strike transition with separated columns.

The disclosure relates to a different energy transformation system for footwear. It provides for efficient cushioning and control with its four column one-piece configuration. The system is designed to give a highly effective level of combination of cushioning, balance, stability, and drive.

These features include:

- The multi-tier compression zones of each heel column allow for good cushioning during initial heel strike. The separated columns also allow for individualized compression while absorbing large impacts much like an independent suspension system.
- Individual column geometry secures good foot positioning and allows for more efficient energy transfer from heel strike to toe off. This is accomplished by an arched bridge between the medial heel columns, and lateral separation of columns to promote flexibility.
- Stability is achieved through the two-piece chassis system. The lower stability plate integrated with the upper chassis system is designed for effective distribution of pressure. This system provides good performance and a stable platform, yet with an extremely comfortable fit and feel.

While each piece of the system has its own function, the combination of them provide for optimal heel displacement of energy and cushioning, allowing for a more efficient transfer of energy from impact to launch.

In a shoe having an upper and a sole structure, there is a cushioning device forming part of the sole structure. The material comprises a flexible resilient elastomeric thermoplastic material. The flexible resilient elastomeric thermoplastic material is comprised of thermoplastic urethanes selected from the group consisting of polyester, polyether, polycaprolactone, polyoxypropylene and polycarbonate macroglycol based materials, and mixtures thereof. Part of the cushioning can include a thermoplastic urethane.

The load carrying cushioning device is an elastomeric polyurethane polymer, and is a component of footwear, preferably, at least part of a heel pad. In some other instances the cushioning device can be part of a partial or full-length sole component.

The cushioning device is formed by any one of or a combination of pressure forming, compression molding, injection molding, slush casting, vacuum forming, blow-molding, rotational molding, or transfer molding. Other components of the sole, namely the plates, the mid-sole and the outsole are formed by a suitable molding technique. The cushioning device is assembled to form part of an article of footwear. The sole can be integrated by molding each component separately and in a final process pressure molding al the components together under heat. The upper may be joined to the sole in this integrated process or in a separate bonding process which can use heat and/or pressure.

The cushioning device is for use preferably in an athletic shoe of the type which includes an upper portion and a sole portion, the sole portion including a heel part and a resilient mid-sole and outsole. The device provides for an improved mechanism for absorbing foot shock, storing and returning running energy to the foot of the wearer, and stabilizing the wearer's foot during running.

The sole is attached to the upper, and the sole has at least a resilient mid-sole and an elastomeric outsole. The mid-sole and the outsole have a heel portion generally disposed below the wearer's heel. The cushioning device is located between the mid-sole, and the outer sole, in the heel portion. The cushioning device is fixed between the mid-sole and outer sole for stabilizing the wearer's heel during heel strike of the foot.

A cushioning device for location in a portion of a sole of footwear comprises multiple vertically directed columns for location in a sole for footwear. At least one of the columns is spaced apart from the other and is formed so that at least some of the columns have different volumetric space relative to other columns. At least one of the columns is for location on a medial side and another of the columns is for location on a lateral side of the footwear, the columns being adjacent each other and being spaced apart from each other. The medial column has the relatively larger volumetric property relative to the volumetric property of the lateral column.

In another sense at least one of the columns has different elastomeric properties relative to other columns. At least one of the columns is for location on a medial side and another of the columns being for location on a lateral side of the footwear, and the medial column has the relatively denser elastomeric property relative to the elastomeric property of the lateral column. In this sense one of the columns would generally recover or return to its initial form or state after deformation at a different rate than another column.

In yet another sense at least some of the columns have different compression properties relative to other columns. At least one column is for location on a medial side and another of the columns is for location on a lateral side of the footwear. The medial column has a relatively larger compression property relative to the compression property of the lateral column. In this sense one of the columns would generally be capable of being made more compact by deformation than another column.

The device is located between an upper support plate and a lower support plate, and the support plates have more rigid characteristics than the cushioning device. The upper plate and lower plate are located for essentially horizontal relationship relatively above and relatively below the cushioning device. At least one of the plates includes an extension for location in a direction towards the toe of a sole. This is in a direction forwardly of a heel. The extension(s) taper and are for engagement together in an area ahead of the columns in a direction towards the toe of the sole.

Each column includes an upper area and a lower area and the upper area is larger than the lower area. Each column includes downwardly directed walls, and the walls preferably have a bellows-effect. There are portions of the wall, which have a smaller circumference, and portions of the wall, which has a larger circumference, and preferably there are at least areas of two larger circumferences in each wall.

At least some of the respective columns generally provide at least a portion the wall that tapers inwardly from an upper location of the column towards a lower location of the column. The lower portion is where the bases of the columns are spaced apart.

In one of the preferred forms there are four spaced columns, a first column on a forward medial side, a second column on a rearward medial side, a third column on a rearward lateral side and a fourth column on a forward lateral side.

The rear, lateral and medial columns are connected by a bridge, and the bridge is located towards the top of the device and the bridge has a volumetric space significantly less than the volumetric space of the respective columns.

The rear, lateral and medial columns are connected by a bridge, and the bridge, the bridge is located towards the top of the device. The bridge has a volumetric space significantly less than the volumetric space of the respective columns.

In one preferred form the forward lateral column is separated on the lateral side from the rearward lateral column.

Also in one preferred form the rearward medial column and the forward medial column are connected by a bridge material. The bridge is located towards the top of the device, and the bridge material is of lesser volumetric space than the volumetric space of the respective medial columns.

The sole also includes an outer sole located substantially below the bottom plate and a mid-sole located substantially over the upper plate. The outer sole is located substantially below the bottom plate and a mid-sole is located substantially over the upper plate.

There can be an upwardly directed lip extending at least partly about an outer periphery of the cushioning device. The upper plate includes an upwardly extending skirt extending at least partly about a periphery of the upper plate, and the skirt of the cushioning device mates with an outer surface of a skirt of the upper plate. The skirt of the upper plates mates with an outer periphery of the mid-sole.

An upwardly directed lip extends at least partly about an outer periphery of the cushioning device and the upper plate includes an upwardly extending skirt extending at least partly about a periphery of the upper plate. The skirt of the cushioning device mates with an outer surface of a skirt of the upper plate and the skirt of the upper plates mates with an outer periphery of the mid-sole.

In one form there are at least four columns, and each column includes a base horizontal zone and the base horizontal zone of each column is relatively different to the base horizontal zone of other columns. The columns are for location respectively at a medial forward position, a medial rearward position, a lateral forward position and a lateral rearward position, and the medial forward position column extends over a larger area than the other columns.

The rear lateral column extends over an area in size and is smaller than the medial forward column and larger than the medial rear column and the lateral forward column.

The disclosure also concerns a method of forming an insert for a sole of footwear. The insert is preferably in a heel of the footwear.

The steps include forming a cushioning device of a synthetic resinous material, the device having a first compression and/or elastomeric characteristic. A plate for accommodation below a cushioning device is formed or provided. The plate is more rigid than the cushioning device. An upper support plate is provided and this is more rigid than the cushioning device. The cushioning device is located between the lower plate and the upper plate, thereby to form an insert for a sole.

At least an outer sole or a mid-sole has different compression and/or elastomeric characteristics than the support plates are molded.

The molding the outer sole and/or the mid-sole about the insert thereby forms a sole for footwear.

In one form the molding of the outer sole and/or the mid-sole is effected simultaneously with securing of the plates about the cushioning device.

Alternatively the outer sole and/or the mid-sole are subsequently molded about the insert thereby to form a sole for footwear. The molding of the outer sole and/or the mid-sole is affected after securing of the plates about the cushioning device.

The lower plate includes an inwardly directed tongue extending rearwardly from a forward end of the lower plate and an inwardly directed hook extending inwardly from the rear of the lower plate, the tongue and the hook acting to secure the cushioning element with the lower plate.

The upper plate and lower plate include portions are intended to lie essentially horizontally above and below the cushioning element respectively and include lead portions tapered towards each other and for anchorage together ahead of the cushioning device. The upper and lower plates include formations extending forwardly from the horizontal areas and where the formations essentially form a fork-like configuration with portions extending peripherally forwardly on the medial and the lateral sides.

Either the upper or lower plate is formed with a formation extending towards the opposite plate such that the formation can act to bond the two plates together.

The disclosure is discussed with reference to the examples as illustrated.

The cushioning device 10 includes four vertically directed columns. There is a medial rear column 12, a forward medial column 14, a lateral rear column 16 and a forward lateral column 18. The columns 12, 14, 16 and 18 are spaced apart.

Column 14 on the medial side has a top horizontal area represented by 20. Column 12 on the rear medial side has a top horizontal area represented by 22. Column 16 on the rear lateral side has a top horizontal area represented by numeral 24 and column 18 on the forward lateral side has a top horizontal area represented by numeral 26. The effective areas 20, 22, 24 and 26 are relatively different in area size. The underportions of each of these columns has a lower base effective areas, respectively indicated by numerals 28, 30, 32 and 34. Those respective areas are less than the upper horizontal areas.

The peripheral side walls 36, 38, 40 and 42, respectively for each column all taper in an overall relative sense from the top horizontal areas 20, 22, 24 and 26, respectively, towards the lower areas 28, 30, 32 and 34, respectively. Thus, there is a narrowing of the walls 36, 38, 40 and 42 from the top towards the bottom of each respective column.

Between the columns 12 and 14, there is a connector strip or bridge 44. There is also a connector strip or bridge 46 between the two rear columns. There is a space 48 between the rear column 16 and forward column 18 on the lateral side.

Bellows-like structures 50 forms part of the peripheral side walls 36, 38, 40 and 42, respectively. There is a central cut-out zone 52 between the four columns 12, 14, 16 and 18.

The cushioning device 10 is sandwiched between an upper support plate 54 and a lower support plate 56. The configuration is such that the lower support plate has a tongue 58 which extends rearwardly from the front end 60 of the support plate and has a hook, clip or tongue 62 which project forwardly from the rear end 64 of the support plate. The hook, clip or tongue 62 is located between the columns 12 and 16 at a position 68 at the rear of the cushioning device 10.

The cushioning device 10 can be positively located with the lower support 56. This is affected by securing the cushioning device 10 with the tongue 58 in an inter-engaging manner on the forward end 66 of the cushioning device 10 and with the hook 62.

The upper and lower support plates at their leading ends directed towards the mid portion or front of the shoe can have different shaped tongue formations. These formations facilitate the stabilizing structure of the sole. The formations can include a flat face transversely across the mid portion of the shoe or there can be extending tine like elements at each of the lateral and medial sides.

The cushioning device also includes a peripheral skirt 70 which extends around at least part of the outside of the columns 12, 14, 16 and 18. The skirt projects upwardly. The upper support plate 54 includes a base 72 and a skirt 74 which extends at least partially around base 72 and upwardly from base 72. There is also portion 76 of the skirt 74 which extends relatively downwardly. The downwardly extending portion of 76 includes an elongated extended protruding line for location in a space 48 between the columns 16 and 18.

The support plates 54 and 56 essentially sandwich the cushioning device 10 between the plates. The base portion 78 of the lower support plate 56 includes four indentations 80, 82, 84 and 86, respectively, arranged around the perimeter of the top face of the support 56. The indentations 80, 82, 84 and 86 locate the lower horizontal areas 28, 30, 32 and 34 of the respective columns 12, 14, 16 and 18, respectively. As can be noted in this area of the respective indentations 80, 82, 84 and 86, the shape is relatively different and the area of each of these indentations is different in shape and in size.

As can be seen on the lateral forward portion where there is accommodation for the column 18, there is a relatively smaller area for the horizontal area of the column. This is the space 86 for accommodating the foot of column 18. The lateral area 84 is relatively large and this is for accommodating the rear column 16 on the lateral side.

On the rear medial side, the space 82 is relatively the smallest area for accommodating the horizontal area of the rear medial column 12. Ahead of that indentation 82 is an indentation 80, which is of medium size for accommodating the column 14. This is on the forward medial side of the cushioning device.

About the cushioning device, which is sandwiched between the support plates 54 and 56, there is a mid-sole 88, which matingly engages so that the base portion 90 of the mid-sole is accommodated at least in part with the base 72 of the support plate 54. The skirt 74 embraces at least in part the outside 92 of the skirt 94 which extends above the inside floor 96 of the mid-sole.

Underneath the lower support 56, there is an outer sole 98, which has a rear area 100 for accommodating the underportion of the lower support 56 and additionally there is a forward area 102, which is under the foot portion of the sole. There is a tab 104 at the rear of the rear area 100 and a tab 106 in the forward portion of the outersole. These portions are turned upwardly and in the assembly process extend to some degree over the entire sole structure and are all part of the upper on the footwear. The rear area also includes cutout section 107 and there is also a cutout section 108 in the lower support 56.

These cutout sections 107 and 108 conform with the cutout 52 in the cushion element. By having this cutout formation, the underneath of the support plate 54 is visible, at least in part through the outer sole, lower support and the columns forming the cushioning device.

This also acts to lighten the sole structure. Additional cutout formations 110 and 112 can be provided to the mid and forward portions of the outer sole once again to lighten the sole and/or to provide for appearance characteristics which are desirable. Such an appearance characteristic could be the feasibility of the underneath of the lower support 56 and/or the underneath of the base portion 90 of the mid-sole 88.

Above the mid-sole 88 an upper is formed for completing the shoe construct. The upper may have any one of different shapes, forms or sizes.

Figure 2:
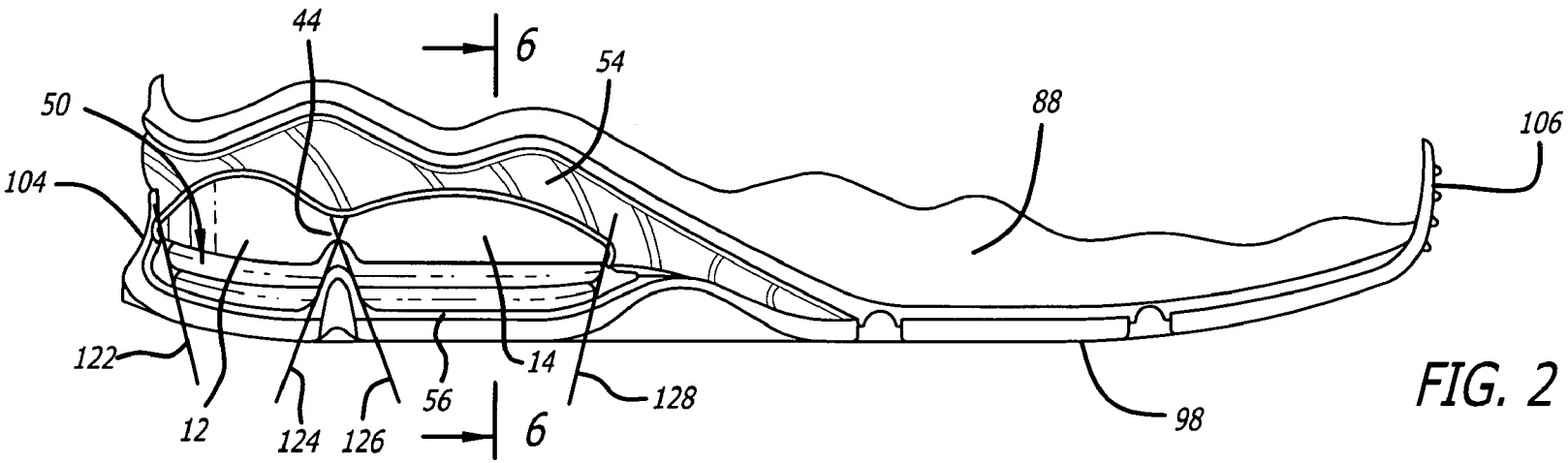
FIG. 2 is a medial side view illustrating the outer sole, support plate, cushioning device, upper support plate and mid-sole.
Figure 3:
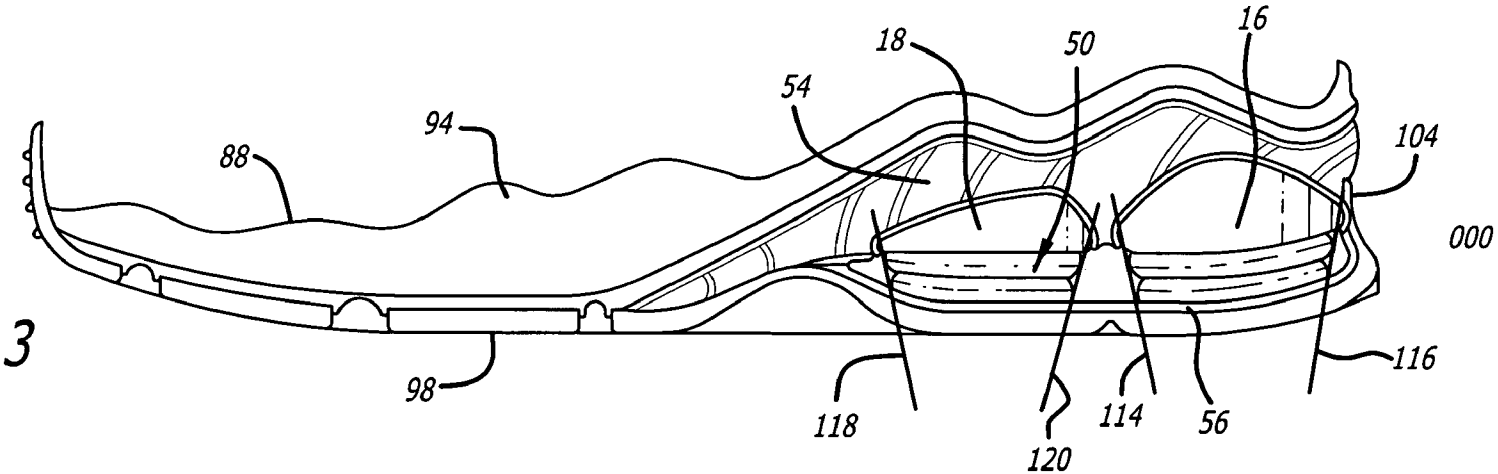
FIG. 3 is a lateral side view illustrating the outer sole, support plate, cushioning device, upper support plate and mid-sole.
Figure 4:
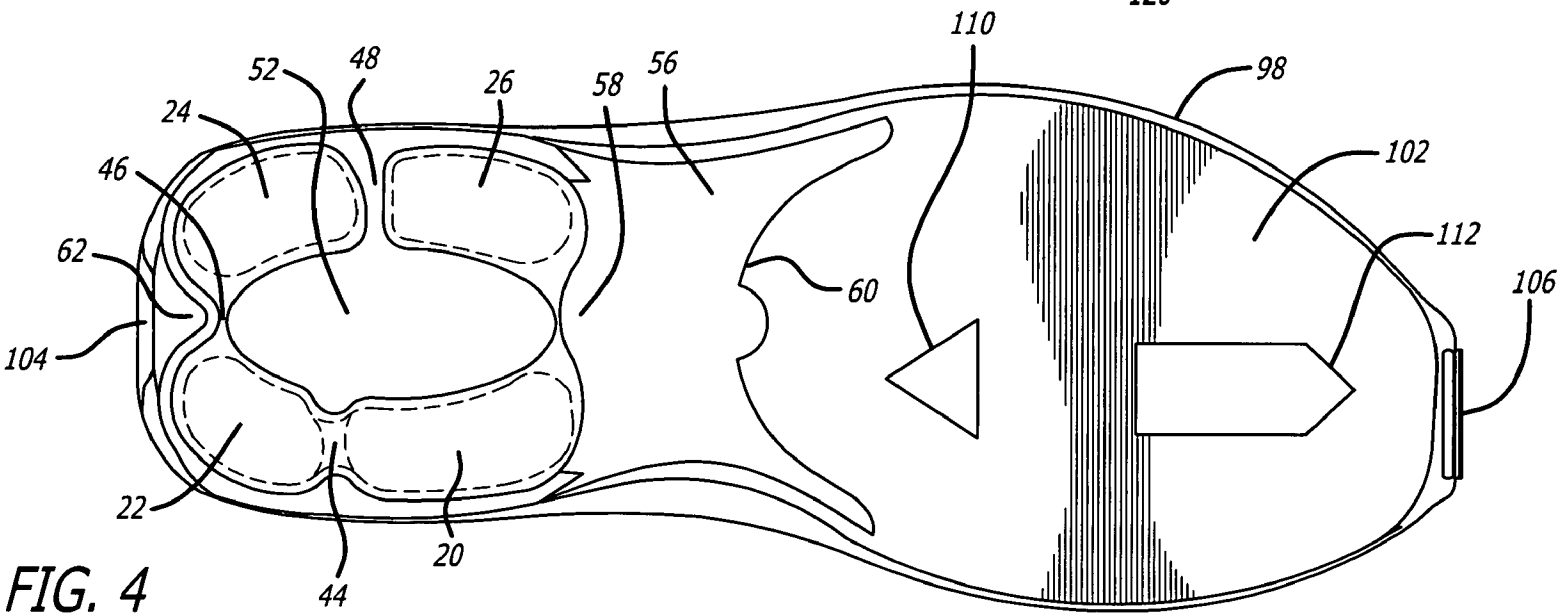
FIG. 4 is a top view illustrating the top of outer sole, the top of bottom support plate and the top of the cushioning device. The upper support plate and the mid sole are not shown in this view.
Figure 7:
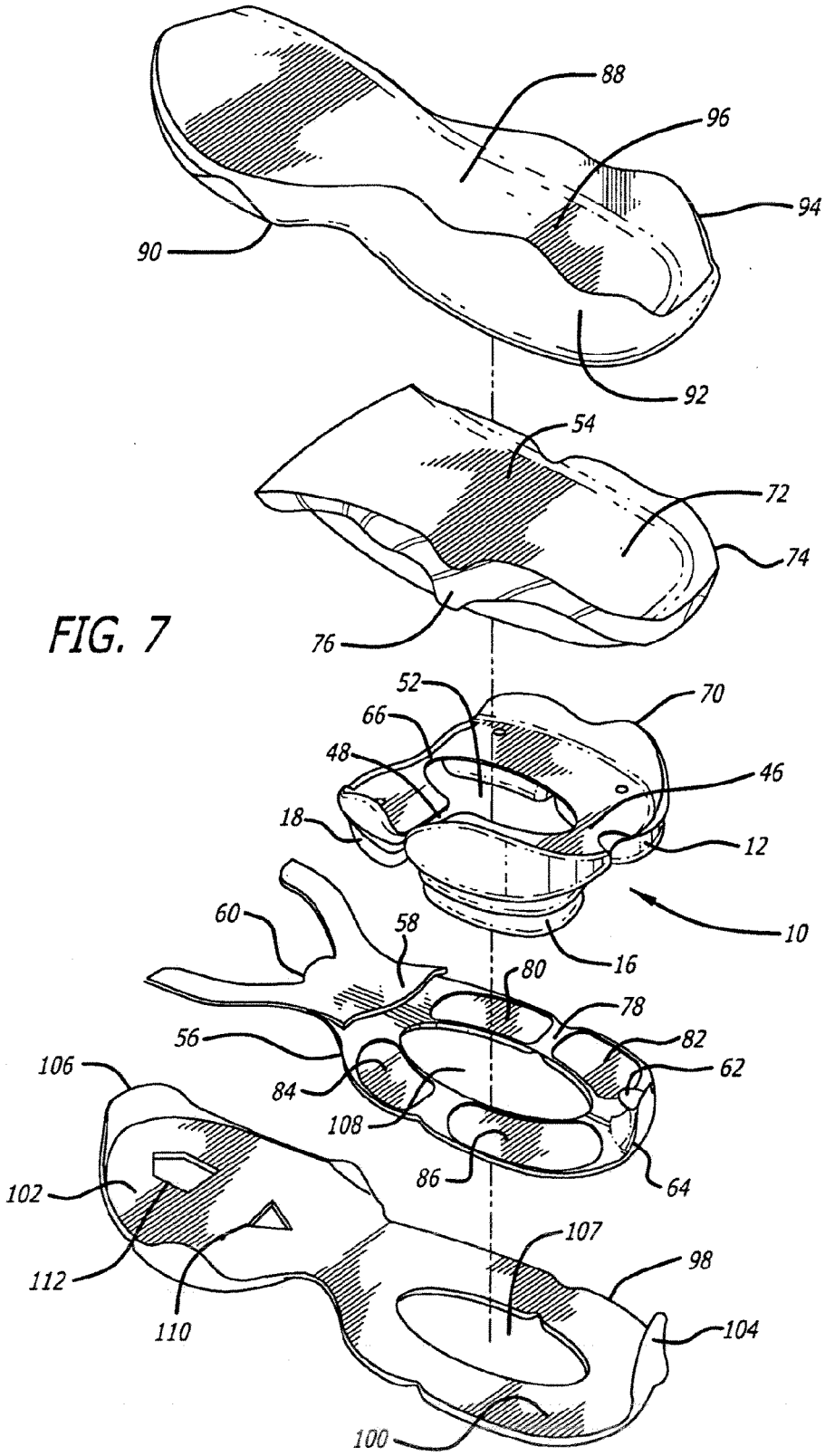
FIG. 7 is an exploded perspective view illustrating the outer-sole, lower support plate, the cushioning device, upper support plate and mid-sole.
Figure 12:
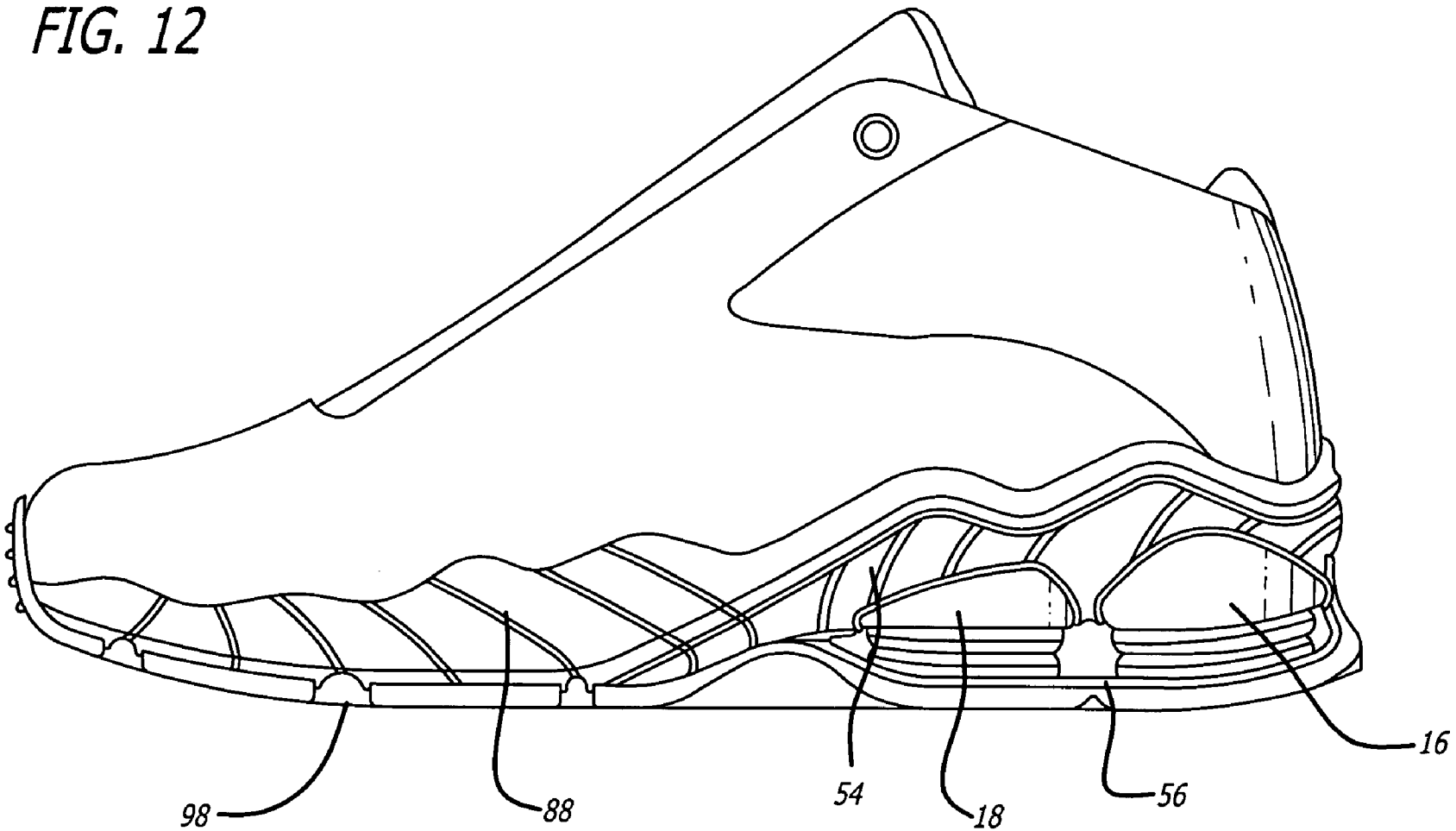
FIG. 12 is a lateral side view illustrating the outer sole, support plate, cushioning device, upper support plate, mid-sole and an upper.

In different forms of the disclosure, different constructs are possible. As can be seen in FIG. 3, the characteristic from a side perspective of the columns 18 and 16 is such that they taper relatively downwardly from the uppermost portion to the lowermost portion. The taper of column 16 is indicated by the lines 114 and 116, respectively. The taper of column 18 is indicated by the lines 118 and 120, respectively. In FIG. 2, the taper on the medial side is indicated respectively for column 12 by lines 122 and 124 and for column 14 by lines 126 and 128. The taper in FIG. 10B are indicated by lines 122, 124, 126 and 128.

As shown in FIGS. 10A and 10B the height X of the rear column are efficiently and essentially greater than the height Y of the forward column.

In different forms there can be constructs which secure the upper support plate 54 on the top of the cushioning device. Pins 126 in the base of the support element are generally aligned with the top horizontal portions of the columns and fit in apertures 128 at the top of the columns of the cushioning device. The pins 126 engage in the apertures 128 during a molding operation. In other situations there can be apertures in the plate and pins molded outwardly from the top of the cushioning device.

In other forms of the disclosure instead of each column tapering as indicated, only certain of the columns may taper. In yet other variations, instead of the taper being such that it is broader at the top and narrower at the bottom, the taper could be in reverse. In yet other forms of the disclosure that could be less than or more than four column elements.

A feature of the disclosure is that the columns have different volumetric amounts and thereby provide different degrees of compression or elastomeric effect at different areas in the cushioning device. Thus, different portions of the heel area have different reaction zones such that the heel of a wearer reacts differently in the shoe. The cushioning device acts to provide different degrees of support to different portions of the heel.

Many other forms of the disclosure are possible without departing from the scope of the disclosure. The invention is to be determined by the following claims.

Thus, a novel system has been shown and described. Various modifications may of course be made without departing from the spirit and scope of the disclosure. The disclosure, therefore, should not be limited, except to the following claims, and their equivalents. While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A cushioning device for location in a portion of a sole of footwear comprising:

multiple vertically directed columns for location in a sole for footwear, at least one of the columns being spaced apart from another column and being formed so that at least some of them have different volumetric space relative to other columns;

at least one the columns being for location on a medial side and another of the columns being for location on a lateral side of the footwear, the columns being adjacent each other and being spaced apart from each other, and wherein the medial column has the relatively larger volumetric property relative to the volumetric property of the lateral column;

wherein the device is located between an upper support plate and a lower support plate, the support plates having more rigid characteristics than the cushioning device;

an outer sole located substantially below the bottom plate and a mid-sole located substantially over the upper plate; and an upwardly directed lip extending at least partly about an outer periphery of the cushioning device and wherein the upper plate includes an upwardly extending skirt extending at least partly about a periphery of the upper plate, and wherein the skirt of the cushioning device mates with an outer surface of a skirt of the upper plate and wherein the skirt of the upper plates mates with an outer periphery of the mid-sole.

2. A cushioning device for location in a portion of a sole of footwear comprising:

multiple, essentially vertically directed columns for location in a sole for footwear;

at least one of the columns being spaced apart from the another column and the columns being formed so that at least some of them have different elastomeric properties relative to other columns;

at least one of the columns being for location on a medial side and another of the columns being for location on a lateral side of the footwear, and wherein the medial column has the relatively denser elastomeric property relative to the elastomeric property of the lateral column;

wherein the device is located between an upper support plate and a lower support plate, the support plates having more rigid characteristics than the cushioning device;

an outer sole located substantially below the bottom plate and a mid-sole located substantially over the upper plate; and an upwardly directed lip extending at least partly about an outer periphery of the cushioning device and wherein the upper plate includes an upwardly extending skirt extending at least partly about a periphery of the upper plate, and wherein the skirt of the cushioning device mates with an outer surface of a skirt of the upper plate and wherein the skirt of the upper plates mates with an outer periphery of the mid-sole.

3. A cushioning device for location in a portion of a sole of footwear comprising:

multiple vertically directed columns for location in a sole for footwear;

at least one of the columns being spaced apart from another column and being formed so that at least some of them have different volumetric space relative to other columns;

at least one the columns being for location on a medial side and another of the columns being for location on a lateral side of the footwear, the columns being adjacent each other and being spaced apart from each other, and wherein the medial column has the relatively larger volumetric property relative to the volumetric property of the lateral column;

wherein the device is located between an upper support plate and a lower support plate, the support plates having more rigid characteristics than the cushioning device;

an outer sole located substantially below the bottom plate and a mid-sole located substantially over the upper plate; and an upwardly directed lip extending at least partly about an outer periphery of the cushioning device and wherein the upper plate includes an upwardly extending skirt extending at least partly about a periphery of the upper plate, and wherein the skirt of the cushioning device mates with an outer surface of a skirt of the upper plate and wherein the skirt of the upper plates mates with an outer periphery of the mid-sole.

4. A cushioning device for location in a portion of a sole of footwear comprising:

multiple, essentially vertically directed columns for location in a sole for footwear;

at least some of the columns being spaced apart from another column and the columns being formed so that at least some of them have different compression properties relative to other columns;

at least one the columns being for location on a medial side and another of the columns being for location on a lateral side of the footwear, and wherein the medial column has the relatively larger compression property relative to the compression property of the lateral column; and wherein at least one of the lower plate or upper plate includes a formation for hooking with the cushioning device, the hooking formation extending such that with the upper or lower plate it is directed substantially so as to sandwich the cushioning device between the plate and the hooking formation, and wherein there can selectively be a hooking formation in a rear and forward end of the plate.

5. A cushioning device for location in a portion of a sole of footwear comprising:

multiple vertically directed columns for location in a sole for footwear;

at least one of the columns being spaced apart from another column and being formed so that at least some of them have different volumetric space relative to other columns;

at least one the columns being for location on a medial side and another of the columns being for location on a lateral side of the footwear, the columns being adjacent each other and being spaced apart from each other, and wherein the medial column has the relatively larger volumetric property relative to the volumetric property of the lateral column;

wherein there are at least four columns, and wherein each column includes a base horizontal zone and wherein the base horizontal zone of each column is relatively different to the base horizontal zone of other columns and wherein the columns are for location respectively at a medial forward position, a medial rearward position, a lateral forward position and a lateral rearward position, and wherein the medial forward position column extends over a larger area than the other columns; and wherein the rear lateral column extends over an area in size and is smaller than the medial forward column and larger than the medial rear column and the lateral forward column.

6. A cushioning device for location in a portion of a sole of footwear comprising:

multiple, essentially vertically directed columns for location in a sole for footwear;

at least one of the columns being spaced apart from the another column and the columns being formed so that at least some of them have different elastomeric properties relative to other columns;

at least one of the columns being for location on a medial side and another of the columns being for location on a lateral side of the footwear, and wherein the medial column has the relatively denser elastomeric property relative to the elastomeric property of the lateral column;

wherein there are at least four columns, and wherein each column includes a base horizontal zone and wherein the base horizontal zone of each column is relatively different to the base horizontal zone of other columns and wherein the columns are for location respectively at a medial forward position, a medial rearward position, a lateral forward position and a lateral rearward position, and wherein the medial forward position column extends over a larger area than the other columns; and wherein the rear lateral column extends over an area in size and is smaller than the medial forward column and larger than the medial rear column and the lateral forward column.

7. A cushioning device located in a heel of footwear comprising:

multiple vertically directed columns for location in the heel for footwear;

at least two columns in a rear peripheral area of the heel and at least two in a forward peripheral area of the heel, the four columns being spaced apart from each other and being formed so that at least some of them have different volumetric space relative to other columns;

at least one the columns being for location on a medial side and another of the columns being for location on a lateral side of the footwear;

at least some of the columns having effectively relatively tapered sidewall profile in that the top of the columns is different in cross sectional area relative to the bottom of the cross sectional area of the columns;

wherein there are only four peripheral columns and each column includes a base horizontal zone and wherein the base horizontal zone of each column is relatively different to the base horizontal zone of other columns and wherein the columns are for location respectively at a medial forward position, a medial rearward position, a lateral forward position and a lateral rearward position, and wherein the medial forward position column extends over a larger area than the other columns; and wherein the rear lateral column extends over an area in size and is smaller than the medial forward column and larger than the medial rear column and the lateral forward column.

8. A cushioning device located in a heel of footwear comprising:

multiple vertically directed columns for location in the heel for footwear;

at least two columns in a rear peripheral area of the heel and at least two in a forward peripheral area of the heel, the four columns being spaced apart from each other and being formed so that at least some of them have different volumetric space relative to other columns;

at least one the columns being for location on a medial side and another of the columns being for location on a lateral side of the footwear;

at least some of the columns having effectively relatively tapered sidewall profile in that the top of the columns is different in cross sectional area relative to the bottom of the cross sectional area of the columns; and wherein there are at least four columns, and wherein each column includes a base horizontal zone and wherein the base horizontal zone of each column is relatively different to the base horizontal zone of other columns and wherein the columns are for location respectively at a medial forward position, a medial rearward position, a lateral forward position and a lateral rearward position, and wherein the medial forward position column extends over a larger area than the other columns.

9. A cushioning device located in a heel of footwear comprising:

multiple essentially vertically directed columns located in the heel for footwear;

at least one of the columns being for location on a medial side and another of the columns being for location on a lateral side of the footwear, and wherein the medial column has the relatively denser elastomeric property relative to the elastomeric property of the lateral column;

at least some of the columns having effectively a relatively tapered sidewall profile in that the top of the columns is different in cross sectional area relative to the bottom of the cross sectional area of the, columns; and wherein there are at least four columns, and wherein each column includes a base horizontal zone and wherein the base horizontal zone of each column is relatively different to the base horizontal zone of other columns and wherein the columns are for location respectively at a medial forward position, a medial rearward position, a lateral forward position and a lateral rearward position, and wherein the medial forward position column extends over a larger area than the other columns.

10. A cushioning device located in a heel of footwear comprising:

multiple essentially vertically directed columns located in the heel for footwear;

at least one the columns being for location on a medial side and another of the columns being for location on a lateral side of the footwear;

wherein the medial column has the relatively larger compression property relative to the compression property of the lateral column;

at least some of the columns having effectively relatively tapered sidewall profile in that the top of the columns is different in cross sectional area relative to the bottom of the cross sectional area of the columns; and wherein there are at least four columns, and wherein each column includes a base horizontal zone and wherein the base horizontal zone of each column is relatively different to the base horizontal zone of other columns and wherein the columns are for location respectively at a medial forward position, a medial rearward position, a lateral forward position and a lateral rearward position, and wherein the medial forward position column extends over a larger area than the other columns.

11. A cushioning device for location in a portion of a sole of footwear for aiding in the prevention of an over-supination effect, the device comprising:

multiple vertically directed columns for location in a sole for footwear, at least one of the columns being spaced apart from another column and being formed so that at least some of them have a relatively different volumetric, elastometric or compression property relative to other columns;

at least one the columns being for location on a medial side and another of the columns being for location on a lateral side of the footwear, the columns being adjacent each other and being spaced apart from each other, wherein the relatively different volumetric, elastomeric or compression property aids in prevention of over-supination;

wherein the device is located between an upper support plate and a lower support plate, the support plates having more rigid characteristics than the cushioning device;

an outer sole located substantially below the bottom plate and a mid-sole located substantially over the upper plate; and an upwardly directed lip extending at least partly about an outer periphery of the cushioning device and wherein the upper plate includes an upwardly extending skirt extending at least partly about a periphery of the upper plate, and wherein the skirt of the cushioning device mates with an outer surface of a skirt of the upper plate and wherein the skirt of the upper plates mates with an outer periphery of the mid-sole.

* * * * *